US009345631B2

(12) United States Patent
Daneshvar

(10) Patent No.: US 9,345,631 B2
(45) Date of Patent: May 24, 2016

(54) DANESHVAR PATIENT ELEVATOR, ROTATOR AND METHODS

(75) Inventor: Yousef Daneshvar, West Bloomfield, MI (US)

(73) Assignee: AMERICAN MEDICAL CORPORATION

( * ) Notice: Subject to any disclaimer, the term of this patent is extended or adjusted under 35 U.S.C. 154(b) by 2831 days.

(21) Appl. No.: 11/803,455

(22) Filed: May 15, 2007

(65) Prior Publication Data

US 2007/0266496 A1 Nov. 22, 2007

Related U.S. Application Data

(60) Provisional application No. 60/801,245, filed on May 18, 2006.

(51) Int. Cl.
*A61G 7/10* (2006.01)

(52) U.S. Cl.
CPC ..... *A61G 7/1098* (2013.01); *A61G 7/1019* (2013.01); *A61G 7/1046* (2013.01); *A61G 7/1076* (2013.01); *A61G 2200/34* (2013.01); *A61G 2200/36* (2013.01)

(58) Field of Classification Search
CPC ..... A61G 7/10
USPC ..... 5/81.1 RP, 662, 507.1, 81.1, 83.1
See application file for complete search history.

(56) References Cited

U.S. PATENT DOCUMENTS 5,524,303 A * 6/1996 Palmer et al. ..... 5/81.1 RP
2005/0076436 A1* 4/2005 Hahn et al. ..... 5/81.1 R

* cited by examiner

*Primary Examiner* — Fredrick Conley

(57) ABSTRACT

Transportation and placement of elderly patients and patients with movement problems to a exam room and on a exam table is difficult and cumbersome. Many times patients need help to move to the exam room. The customary exam tables in the exam rooms have a higher height thus the patient has to move up one step and then to rotate for being able to sit on the exam table. Performing these movements, moving up and the rotation are difficult and time consuming when the person has neuro-muscular or arthritic problems. Many times a nurse or the doctor has to help the patient which has its own difficulties and make cause back pain of the staff members. The same case is true when a patient needs to be moved from a bed to a stretcher and again significant help is needed which needs a capable worker and may cause back problem in such health care providers. For this reason an easier method will be welcomed in solving this problem.

This invention introduces a unique method which a unit allows a patient to be placed in this unit, to be elevated in order to match the height of the exam table and then to be rotated to sit easily on the exam table. One version of this unit also allows the patient to be wheeled to the exam room. Thus decreasing many steps and simplifying the moves. The use of mechanical tools for this purpose will decrease the human work and save time and energy and prevent the human injuries.

19 Claims, 7 Drawing Sheets

DANESHVAR PATIENT ELEVATOR, ROTATOR AND METHODS

This application incorporates by reference and claims the priority of the provisional application No. 60/801,245 filed on May 18, 2006.

BACKGROUND OF THIS INVENTION

Transportation and placement of the elderly and patients with movement problem to the exam room and on an exam table is difficult and cumbersome. Commonly, in the exam rooms, such patients need to be helped for going on the top of the exam tables which have a higher height. In this process commonly, the patients have to move up one step and rotate for being able to sit on the exam table. Performing these movements: moving up one step and then a 180 degree rotation are difficult, painful and time consuming for an elderly and patients who have neuro-muscular and/or arthritic problems. Many times a nurse or the doctor has to help such patients, which is an extra job, time consuming and may not be easy for a helper who may have their own difficulties, and it may cause back pain or joint pain on them. The same case is true when a patient needs to be moved from a bed to a stretcher and again significant help is needed which needs a capable worker and may cause back or joint problems in such health care providers. For this reason an easier method will be welcomed in solving this problem.

BRIEF EXPLANATION OF INVENTION

This invention introduces a method which a mechanical unit allows a patient to be placed on this unit, and be elevated in order to match the height of the exam table and then to be rotated for sitting on the exam table. One version of this unit also allows the patient to be wheeled to the exam room as well. This method will decrease and eliminate few steps of such a move and simplify this process. Thus use of a mechanical tool will decrease the human work, save time and energy and also prevent from human suffering and cuts injuries.

THE FIGURES

Please notice that the reason there are multiple figures is that the applicant was simply not able to illustrate all of the options in a few figures. Therefore, in order to illustrate his ideas in this application, he chooses to show them in multiple figures. However, the applicant respectfully indicates that his opinion is to have these options be combined and used in the main device if applicable. All other devices can be made based on the teachings of this application.

DETAILED EXPLANATION OF THE FIGURES

Figure 1:
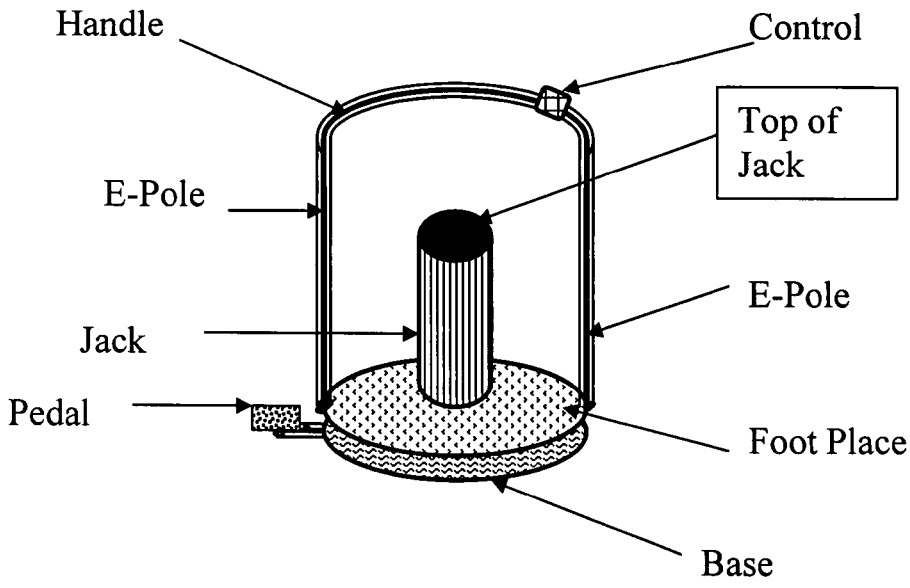
FIG. 1 shows schematically a patient elevator and rotator.

FIG. 1 shows schematically a patient elevator and rotator (PER) which consist of 1. A base, Base which is a flat, rigid, metal plate, designed for standing on the floor for keeping the attached unit stable. This base may have various shapes and configurations and importantly it may have an extension, shown at FIG. 2 for placement under the exam table in order to prevent the unit from tilting, instability and the free movements. The weight of the exam table on the extension will keep the whole unit stable. This piece may have surfaces covered with materials such as shaped rubber to prevent skidding.

2. A strong, round, rigid plate designed for allowing a patient to stand on it and be rotated around the center of this plate. This plate is shown at Foot Stand that is located on the on the front of the base, Base. The Foot Stand has a central, cylinderical piece, Jack which is made from a rigid metal or polymer that has a cylindrical shape with a hollow space and a flat top, designed to stand on the top of a jack. The placement of this cylindrical piece, Jack on a jack makes the whole piece with the foot stand, Foot Stand included to move up and down, with the movement of the jack. Thus the combination allows the jack to be used for the elevation of the Foot Stand. Importantly, the Foot Stand and its attached parts has a rotational base and use a method that allows the foot stand rotate on the base, Base. The center of this rotation is the center of the jack, Jack, thus the front of the Foot Stand will rotate 180 degree on a vertical axis moving from the front position to the back and vise versa, rotating the patient when he/she is standing on it. The base has poles, E-Pole that are securely and vertically attached to the Foot Stand with a connecting semi circular handle, Handle on the top, attached to the poles, E-Pole securely. The E-Poles have means that allows the height of the E-Poles to be adjusted, decreased or increased. This is by allowing one piece of the pole fitting adjustably, inside the other as commonly known. Also they have a hinge means, Hinge shown at FIG. 2 that allows the handle, Handle to be rotated if needed.

3. A jack means, located under the central, cylinderical piece shown at Jack. This jack is a mechanical or an electrical unit, that is placed under the Jack, and its shaft is under the top piece of the Jack, so that the Jack will in fact sit on the top of the shaft of the jack means. So that the elevation of shaft of the jack means will elevate the Jack and the Foot Stand. A control pedal, Pedal allows the jack to be activated and functional.

A control means, Control shows symbolically on the handle would also allow the functions of this unit to be controlled. This control means may have the following function.

A. It will lock the unit so that in locked position the Foot Stand will not rotate. The unlocked position allows the rotation of the Foot Stand.

B. It may control the jack electrically to elevate or lower the jack, Jack.

C. It may control the tilting and height of the elevator poles, E-Pole and allow the height of the poles and adjustments.

D. It may sound an alarm.

Importantly, the Foot Stand, Foot Stand may have a short wall located around its lower border in order to allow the unit to stand on the base or partially on the floor when lowered. This design is to make the Foot Stand to stand securely, when lowered.

The surface of the Foot Stand may have a non-skidding cover, such as rubber for preventing from slipping.

Figure 7:
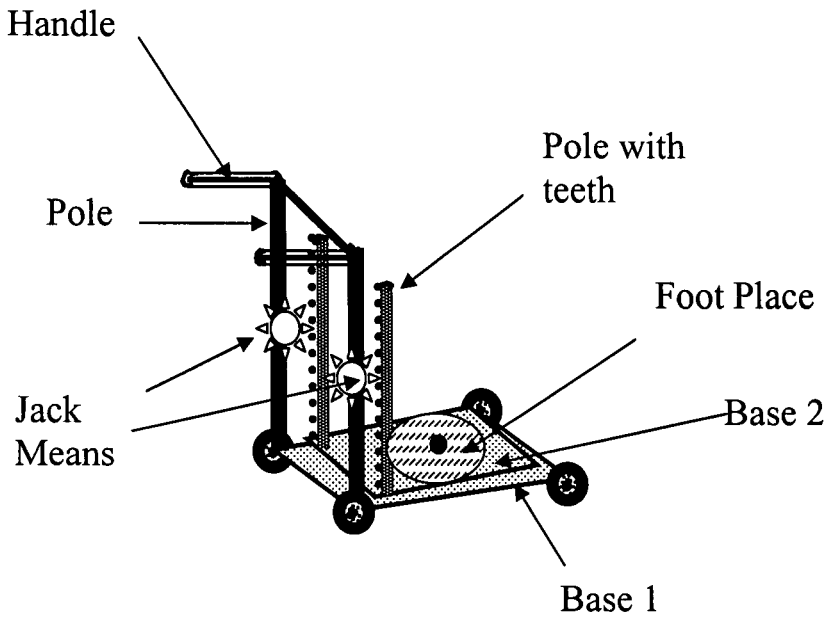
FIG. 7 shows a patient mover, elevator and rotator.

Importantly, in some models the jack means will not be limited to the central location, to one mechanism or another. In certain models the jack means may be placed in the sides or another location for lifting the Foot Stand from the sides. As shown in FIG. 7.

Figure 2:
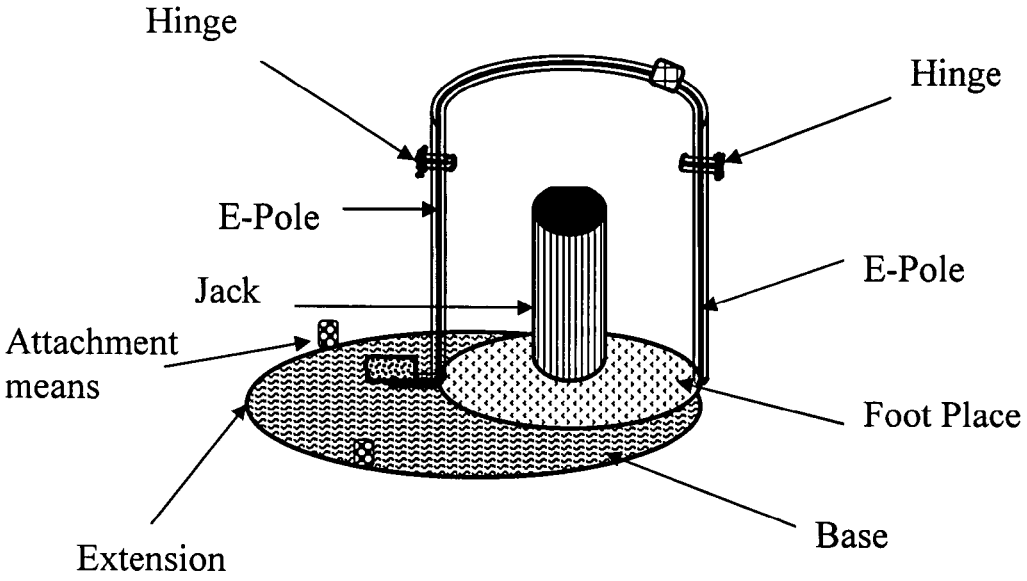
FIG. 2 shows a patient elevator and rotator with an extended base and hinged handle.

FIG. 2 shows schematically a patient elevator and rotator similar to the unit shown at FIG. 1 except in this figure the unit has hinges, Hinge in the elevator poles, E-Pole so that it allows the handle, Handle to be tilted or rotated. This allows the extension for the feet from the exam table to be pulled out without being blocked by the handle, Handle. Also this figure shows a base which has a rigid, extension, Extension which allows it to be placed under the base of the exam table. So the weight of the exam table on extension part of the base will keep the body of the PER secure and will prevent it being tilted or fall. This extension will be in the rear part of the PER unit and since the unit rotates its position can be adjusted. Attachment means, Attachment means, such as snap means may be used to attach the base, Base to the body of exam table on a detachable, re-attachable basis, to further secure the position of the PER.

Importantly, this unit may have wheels to allow the unit to be wheeled in and out of the exam room so that the patient may be moved out and inside of the exam room by this unit. This will simplify the movement of a disabled patients. This model is shown at FIG. 3.

Figure 3:
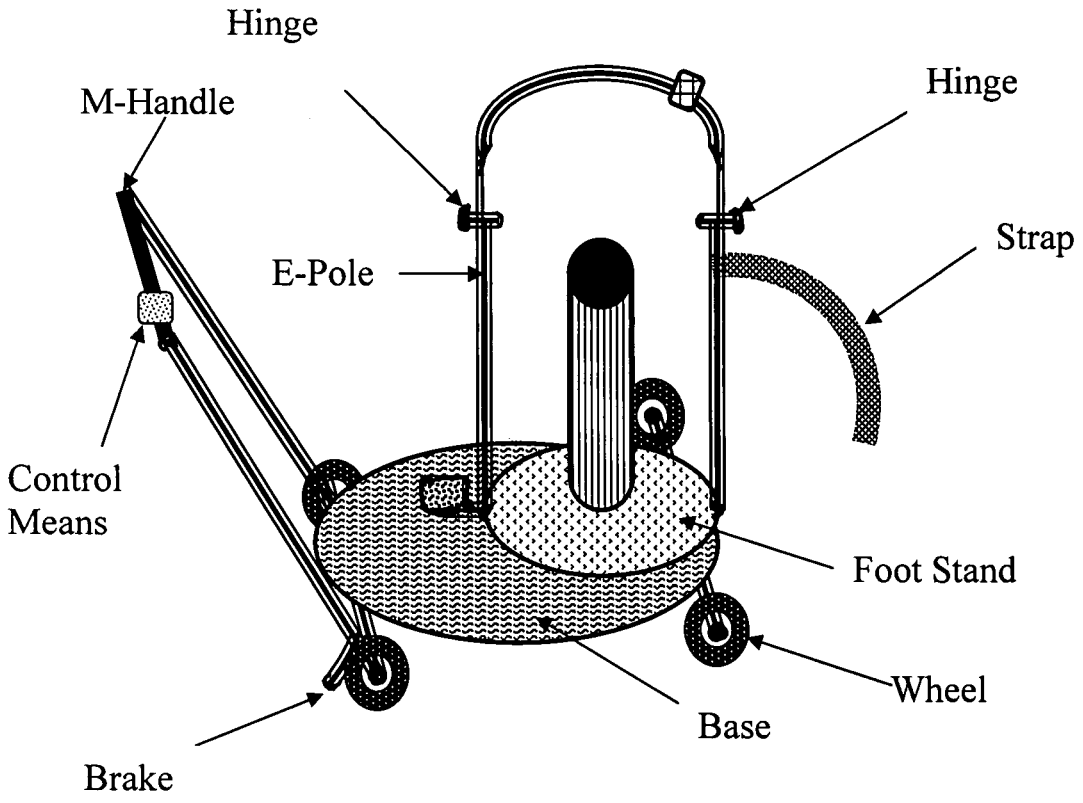
FIG. 3 shows a patient elevator and rotator with wheels and handle which allows it to be moved around.

FIG. 3 shows schematically a PER similar to the unit shown at FIG. 2 except this unit has a series of wheels, Wheel that allows the unit to be wheeled on the floor. This method allows the unit to be wheeled in and out of the room while patient is standing on it. The unit has a handle means, M-Handle, which allows the moving of the unit while a patient is standing on this unit. The advantage of this unit is that it allows a patient with difficulty in movement to be moved from a waiting room or a parking lot to an exam room and to be placed on the table easily. After the examination patient may be moved out to the original place without much of problem. These units are designed for patients with significant ambulation difficulty. Importantly, these units may be made to be motorized in order to be wheeled without effort.

A strap means, Strap will go around the patient and attach to the pole of the unit to keep the patient secure.

The unit has a brake means, Brake, that can be used to hold the unit in a given position when desired such as during the placement of the patient.

Figure 4:
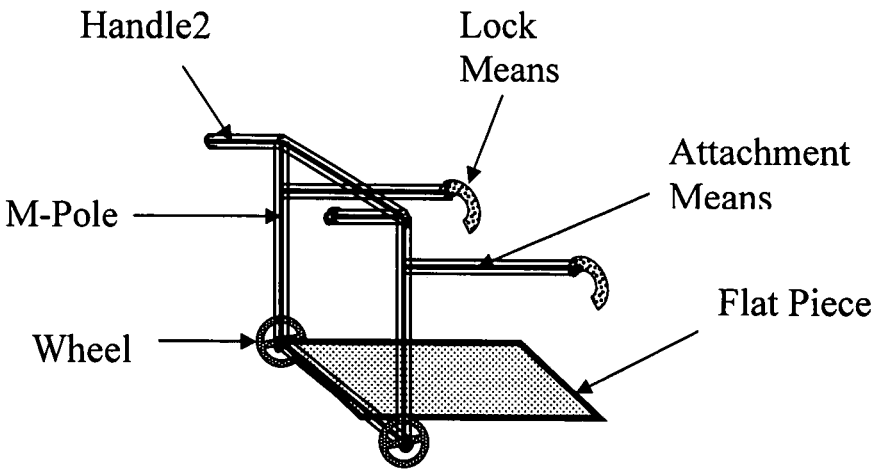
FIG. 4 shows a unit with wheels that allows a patient elevator and rotator to be moved around.

FIG. 4 shows schematically a complimentary patient mover designed to move the PER similar to the unit shown at FIG. 1. This unit has a flat piece, Flat Piece with a series of wheels, Wheel, poles, M-Pole and handle, Handle. Which will function as a dolly which has further parts to complement the PER and move it. Basically, the flat piece, Flat Piece of this unit will be placed under the base, Base of the PER shown at FIG. 1 and to be kept securely by use of attachment means, Attachment Means. After such placement this unit allows that PER to be wheeled around, while patient is standing on it. The advantage of use of this unit is as follows.

1. It makes it easy to the patient
2. It makes the process of moving patient to take less time.

Importantly, the attachment means, Attachment Means have proper size and position to stand adjacent to the poles of the patient elevator and to be attached to them. The attachment means have special locking means, Lock Means at the end of the attachment means, Attachment Means that allow the poles from the patient elevator, rotator, E-Pole to be secured so that it will be safe for the patient and prevent them from falling. The unit also may have a safety belt which will go around the patient to prevent patient from falling while being wheeled. AS shown at FIG. 3.

Importantly, the unit may have an attachment that will allow the patient to sit on it.

Figure 5:
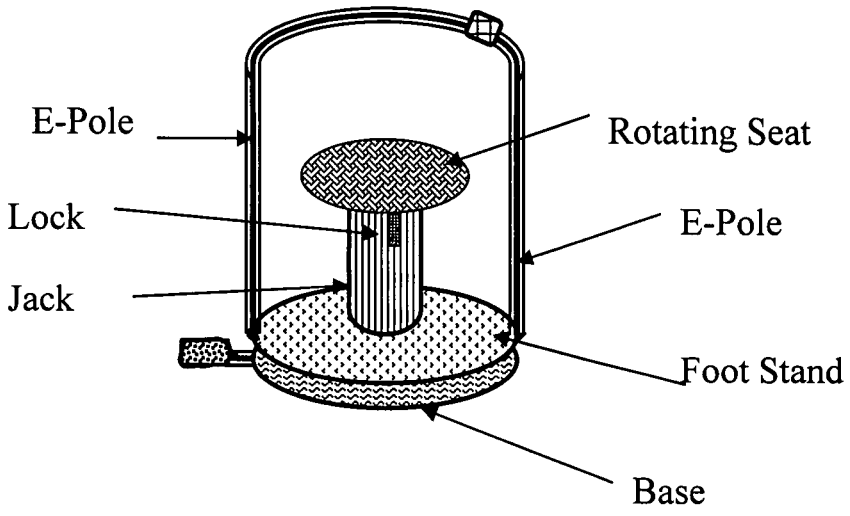
FIG. 5 shows a patient elevator and rotator with a seat.

FIG. 5 shows schematically a patient elevator, rotator, which has a rotating seat, Rotating Seat on the top of the center piece, Jack so that it allows the patient to be seated and rotated for having the proper position for placement. This seat may have a lock means, Lock to allow the seat to be kept locked in one position and also to allow only certain degree of rotation such as 180 degree rotation.

Figure 6:
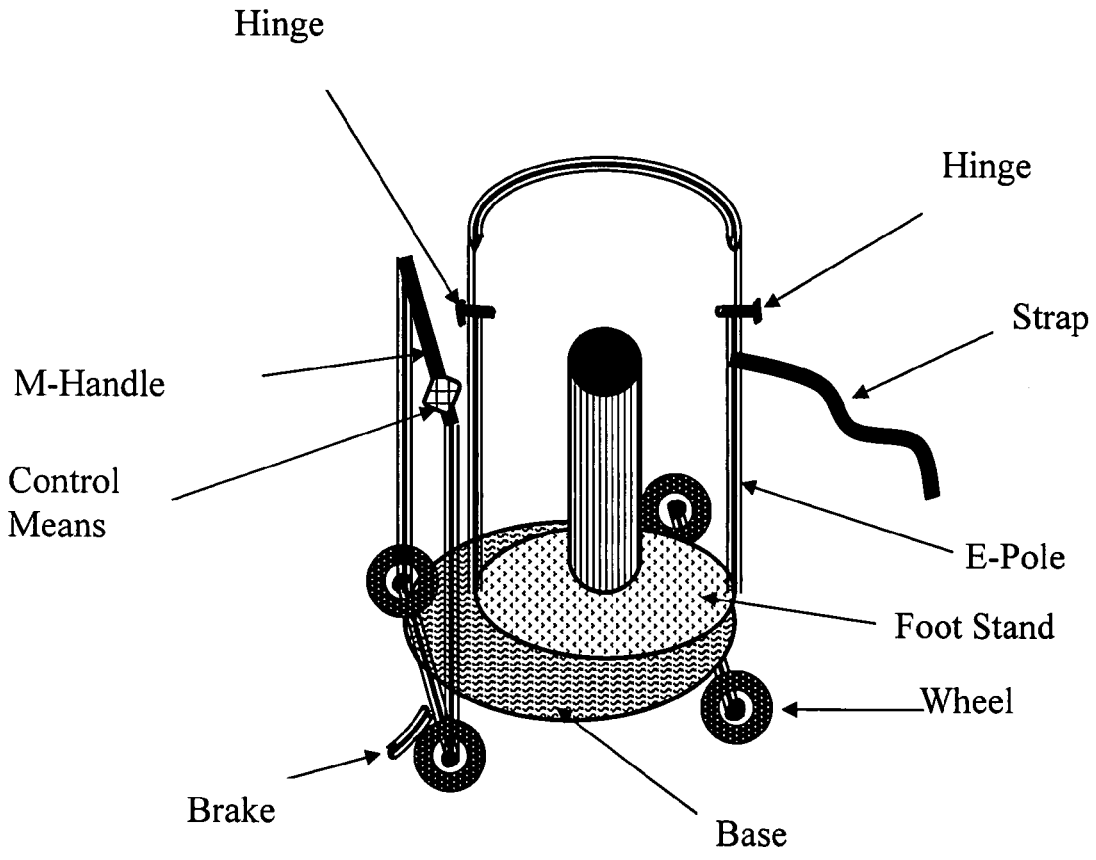
FIG. 6 shows a different version of the unit shown at FIG. 3.

FIG. 6 shows schematically a patient mover rotator similar to the unit shown at FIG. 3 except this unit has poles with the control means, Control Means, on its handle, M-Handle that allow the movement of an electrical jack and other parts to be managed by the staff member. Importantly, the angle of the poles and M-Handle compared to the base, Base can be modified in order to make it vertical or oblique which ever is preferred.

FIG. 7 shows schematically a patient elevator-rotator which consist of a first base, Base 1 with poles, Pole and handles, Handle and wheels that allows this unit to move around. These poles, Pole also have two jack means, Jack in its sides that are capable of elevating and lowering the second base, Base 2 by moving the poles, Pole with teeth attached to Base 2. The second base, Base 2 stands on the first base, Base 1 and has two poles with teeth, Poles with teeth that engage with the jack means, Jack Means from the poles, Pole of the first base, Base 1. This method allows the use of the jack means for elevating and lowering of the Base 1. A Foot Stand, Foot Stand allows the patient to stand on it and is able to rotate on its center. Importantly, the Foot Stand, Foot Stand may have a handle of its own, as shown at Patient-Handle in FIG. 8. It may also have a seat to allow the patient to sit on it. Importantly, this figure is chosen to show that the jack means of this system is not limited to a central jack means or a particular means, and different jack means may be used in different models.

Figure 8:
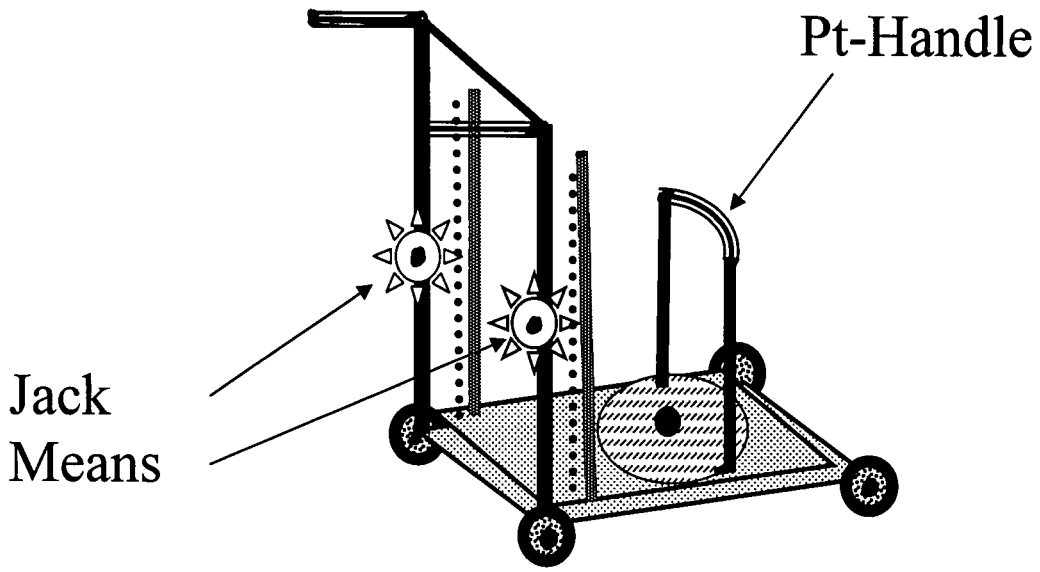
FIG. 8 shows a unit shown at FIG. 7 which has a handle for the patient to hold.

FIG. 8 shows schematically a unit similar to one shown at previous FIG. 7 except this unit has a handle, Pt-Handle attached to the Foot Stand, Foot Stand in order to allow the patient to hold on it.

The means for attachment of this unit to the table.

This unit may use various means of stabilization in order to allow securing this unit to the exam table during the placement period and to be disconnected and free when the patient is being moved.

These means can be.

1. Means of attachment to the exam table, snaps, fastener means etc.
2. Means such as the extension of the base which can be placed under the exam table
3. Any other means.

The means for attachment of moving means to this unit.

The attachment of the main body of this unit to the moving means of this unit may be detachable and reattachable. So that the unit may be used as a stationary unit to a moveable unit.

1. Means of attachment to the exam table
2. Means such as the extension which can be placed under the exam table The Detailed Explanation of this Unit.

Transportation and placement of the elderly patients and patients with movement problems to and on a exam table is difficult, time consuming and cumbersome. Many times patients need help by holding their hands, using cane or walker and wheelchairs for moving them to the exam room. In the exam rooms since the customary exam tables have a higher height, there is a need for the patients to move one step higher, then to rotate for being seated on the exam table. These steps are difficult and time consuming when the person has vision, neuro-muscular or arthritic problems. Many times a nurse or the doctor has to help the patient in moving up, rotation and being placed on the exam table. However, the process of helping by the medical staff has its own difficulties and risks such as time loss and pain induction in helpers. The same is true when a patient needs to be moved from a bed to a stretcher etc., which a capable staff is needed and in some cases this process may cause back or other problems in the health care providers. For these reasons an easier method will be welcomed in solving this problem. This application introduces a method which a mechanical unit allows a patient to be moved, rotated and be elevated in order to match the height of the exam table and sit easily on the exam table. This idea is modified to make different versions of this unit with different options in order to meet the need of a specific room. This method decreases many steps of the movement of the patient and simplifies the moves. Thus the use of tools for this purpose will decrease the human work and save time and energy and prevents the human injuries. The prototype of this unit is shown at FIG. 1 which shows schematically a patient rotator which consist of 1. A base, Base which is a flat, rigid, metal piece, designed for standing on the floor for keeping the attached unit stable. This base may have various shapes and varieties. Importantly it may have an extension, shown at FIG. 2 for placement under the exam table in order to prevent the unit from tilting and free movement.

2. A sturdy, rigid plate designed for patients to stand on it and to be rotated. This piece has a round shaped it is a rigid plate, shown at Foot Place on FIGS. 1 and 2 and it stands on the base. The Foot Place has a central piece, Jack that is also made from a rigid metal or a strong polymer that has a cylindrical shape with hollow space under and a flat top, Top of Jack designed to stand on the top of a jack means. The placement of this cylindrical piece on the jack means makes the whole piece with foot places, Foot Place to move up when the jack is moving up, thus the combination allows the jack to be used for elevation of the Foot Place when desired. Importantly, the Foot Place and its attached parts has a rotational base and method that allows it to rotate on the base, Base. The center of this rotation is the center of the Jack, thus the front of the Foot Place can rotate on a vertical axis in order to move to the back position and vise versa. The unit has poles, E-Pole that are securely and vertically attached to the Foot Place with a connecting semi circular handle, Handle attached to the poles, E-Pole securely. The E-Poles have means that allows the height of the unit to be adjusted, decreased or increased. Also they have a hinge means, Hinge shown at FIG. 2 that allows the handle, Handle to be turned down if needed.

Imp, the pole means, E-Poles may be made from one single pole that attaches to the handle, Handle.

3. A jack means, that is located under the cylinderical center piece shown at Jack. This is a mechanical or an electrical jack that functions to elevate the Jack and Foot Place. A control pedal, Pedal allows the jack to be activated and functional.

The control means, Control on the handle shows symbolically a means that allows various function of this unit to be controlled. This control means may have the following A. It will lock the unit so that in locked position the Foot Place will not rotate. The unlocked position allows the rotation of the Foot Place.

B. It may control the jack electrically to elevate or lower the jack, Jack.

C. It may control the tilting and height of the elevator poles, E-Pole and allow the height of the poles and adjustments.

D. It may sound an alarm.

Importantly, the Foot Place, Foot Place may have a short wall surrounding its lower border in order to allow the unit to stand on the floor when lowered, this is to make the Foot Place to stand securely, when it is on the floor. The surface of the Foot Place may have a non-skidding cover for preventing slipping.

Importantly, the jack means will not be limited to the central location, to one mechanism or another. In certain models the jacks may be placed in the sides or another location to lift the Foot Place from the sides. As shown in FIG. 7.

FIG. 2 shows schematically a patient elevator and rotator similar to the unit shown at FIG. 1 except in this figure the unit has hinges, Hinge in the elevator poles, E-Pole so that it allows the handle, Handle to be tilted or rotated. This allows the extension piece for the feet from the exam table to be pulled out without being blocked by the handle, Handle. Also this figure shows the base which has a rigid, extension, Extension which allows it to be placed under the exam table. By doing so the weight of the exam table will keep the body of the PER securely and will prevent it being tilted or fall. This extension will be in the rear part of the PER unit and since the unit rotates its position can be adjusted. Attachment means, Attachment means, such as snaps, hook and loop fastener or other attachment means, may be used to attach the base, Base to the body of exam table on a detachable, re-attachable basis, to further secure the position of the PER.

Importantly, this unit may have wheels to allow the unit to be wheeled in and out of the exam room so that the patient may be moved out and inside of the exam room by this unit. This will simplify the movement of a disabled patients. This model is shown at FIG. 3.

FIG. 3 shows schematically a patient rotator similar to the unit shown at FIG. 2 except this unit has a series of wheels, Wheel that allows the unit to be wheeled on the floor. This method allows the unit to be wheeled in and out of the room while patient is standing on it. The unit has a handle means, M-Handle attached to it, which allows the moving of the unit while a patient is standing on this unit. The advantage of this unit is that it allows a patient with difficulty in movement to be moved from an area such as a waiting room or a parking lot to an exam room and to be placed on the table easily. After the examination patient may be moved out to the original place easily. These units are designed for patients with significant ambulation difficulty. Importantly, these units may be made to be motorized in order to be wheeled without effort.

The wheels of this unit has a brake means, Brake, that can be used to hold the unit in a given position when desired such as during the placement of the patient. The unit will be operational during the moving process.

FIG. 4 shows schematically a complimentary patient mover designed to move the PER similar to unit shown at FIGS. 1 and 2.

This unit has a flat piece, Flat Piece with a series of wheels, Wheel, poles, M-Pole and handle, Handle. Similar to a dolly which has further parts to complement the PER and move it. Basically, the flat piece, Flat Piece of this unit will be placed under the base, Base of the PER shown at FIG. 1 and to be kept securely by use of attachment means, Attachment Means. After such placement this unit allows that PER to be wheeled around, while patient is standing on it. The advantage of use of this unit is as follows.

1. It makes it easy to the patient

2. It makes the process of moving patient to take less time.

Importantly, the attachment means, Attachment Means have proper size and position to stand adjacent to the poles of the patient elevator. The attachment means have special locking means, Lock Means at the end of the attachment means, Attachment Means that allows the poles from the elevator, E-Pole to be secured so that it will be safe for the patient and it will prevent them from falling. The unit also may have a safety belt similar to the unit shown at FIG. 6 which will go around the patient for preventing patients from falling while being wheeled.

Importantly, the unit may have an attachment that will allow the patient to sit on it.

FIG. 5 shows schematically a patient elevator which has a rotating seat, Rotating Seat on the top of the center piece, Jack so that it allows the patient to be seated and rotated for having the proper position. This seat may have a lock means, Lock to allow the seat to be kept locked in a desired position and also to allow only certain degree of rotation such as 180 degree rotation.

FIG. 6 shows schematically a patient mover rotator similar to the unit shown at FIG. 3 except this unit has poles with the control means, Control Means, on its handle, M-Handle that allow the movement of an electrical jack and other parts to be managed by the staff member. Importantly, the angle of the poles and M-Handle compared to the base, Base can be modified in order to make it vertical or oblique which ever is preferred.

FIG. 7 shows schematically a patient elevator-rotator which consist of a first base, and a second base. The first base, Base 1 is equipped with poles, Pole and handles, Handle and wheels that allows this unit to be moved around. These poles, Pole are equipped with two jack means, Jack in its sides that are capable of elevating and lowering the second base, Base 2 by moving the poles, Pole with teeth attached to Base 2. The second base, Base 2 stands on the first base, Base 1 and has two poles with teeth, Poles with teeth that engage with the jack means, Jack Means from the poles, Pole of the first base, Base 1. This method allows the use of the jack means for elevating and lowering of the Base 1. A Foot Place, Foot Place allows the patient to stand on it and is able to rotate on its center. Importantly, the Foot Place, Foot Place may have a handle of its own, as shown at Patient-Handle in FIG. 8. It may also have a seat to allow the patient to sit on it. Importantly, please note that this figure is schematical and only to show the basic idea that the jack means of patient elevator and rotator may not be limited to a central jack means or a particular jack means, rather it is possible to use any jack means for use in order to allow this kind of unit to be functional.

FIG. 8 shows schematically a unit similar to one shown at previous FIG. 7 except this unit has a handle, Pt-Handle attached to the Foot Place, Foot Place in order to allow the patient to hold on it.

The means for attachment of the means for moving patient around to the elevator means may be detachable and reattachable. So that the patient elevator unit may be used as a stationary unit or a moveable unit. The moving means may have means of attachment to the exam table in order to secure it. Or it may have means such as the extension which can be placed under the exam table The means for attachment of this unit to the table.

This unit may use various means of stabilization in order to allow securing this unit to the exam table during the placement period and to be disconnected and free when the patient is being moved. These means can be.

1. Means of attachment to the exam table, snaps, fastener means etc.

2. Means such as the extension of the base which can be placed under the exam table 3. Any other means.

The elevation means.

Importantly, the elevation means or the jack means is not limited to the central jack or one particular elevation means or another, as it can be noted in FIGS. 7-8 the applicant proposes other methods of elevation of means that the feet stands on them, thus the use of various means of elevation is predicted and can be done based on the teachings of this application.

This idea may be modified in order to allow different models to be made. Also the size, shape, relative sizes and other important characteristics of these units may vary.

What claimed is:

1. A unit for facilitating movement of a physically impaired person by rotational translation of a person about a vertical axis and linear translation of a person along the vertical axis, the unit comprising:

a base for placement on a horizontal surface;

a horizontal platform large enough for occupancy by and underlying support of a person, the base providing underlying support for the platform;

the platform and the base having association that provides for the platform to have both rotational translation about the vertical axis and linear translation along the vertical axis.

2. A unit as set forth in claim 1 including a prime mover that functions to impart linear translation to the platform along the vertical axis and a control for the prime mover.

3. A unit as set forth in claim 2 including at least one pole extending upwardly from the platform, the at least one pole being located radially of the vertical axis toward an outer perimeter of the platform and a handle extending horizontally from the at least one pole at a location above the platform.

4. A unit as set forth in claim 3 in which the handle is associated with the at least one pole by a mounting that provides for the handle to be swung downwardly from horizontal position.

5. A unit as set forth in claim 4 in which the handle has a circularly curved shape centered on the vertical axis and the unit further comprises a strap extending from the at least one pole for going behind a person occupying the platform.

6. A unit as set forth in claim 2 including a rigid upright structure disposed centrally on the platform and having a hollow interior, the rigid upright structure having a top against which a shaft of the prime mover acts to impart linear translation to the platform along the vertical axis via the rigid upright structure.

7. A unit as set forth in claim 2 in which the base includes underlying wheels to provide for the unit to be rolled along a horizontal surface, and a handle that extends from the base and can be grasped for rolling the unit along a horizontal surface.

8. A unit as set forth in claim 7 including at least one pole extending upwardly from the platform, the at least one pole being located radially of the vertical axis toward an outer perimeter of the platform, and an occupant handle extending generally horizontally from the at least one pole at a location above the platform for grasping by a person occupying the platform, the occupant handle being associated with the at least one pole by a mounting that provides for the occupant handle to be swung downwardly from the generally horizontal position, the occupant handle having a circularly curved shape centered on the vertical axis, and the unit further comprising a strap extending between the at least pole behind a person grasping the occupant handle.

9. A unit as set forth in claim 8 in which the at least one pole is vertically adjustable to set the height of the occupant handle.

10. A unit as set forth in claim 2 including a rigid upright structure disposed centrally on the platform and a seat for an occupant supported on the rigid upright structure and arranged to rotate on the rigid upright structure about the vertical axis.

11. A unit as set forth in claim 2 including a wheeled dolly having a horizontal surface on which the base is disposed and a handle that extends from the horizontal surface of the dolly and can be grasped for transporting the unit.

12. A unit as set forth in claim 11 including a mechanism for releasably locking the unit to the dolly.

13. A unit as set forth in claim 11 including a mechanism that acts between the handle of the dolly and the base of the unit for imparting linear translation along the vertical axis to both the base and the platform.

14. A unit as set forth in claim 2 including wheels underlying the base provide for the unit to be rolled along a horizontal surface and in which the base includes structure that extends horizontally beyond the platform and contains features for association with mating features of an article of furniture to secure the unit fast to the article of furniture.

15. A unit as set forth in claim 2 in which the platform comprises structure that comes to rest on a horizontal surface on which the base is disposed when the platform is at lowest elevation relative to the base.

16. A unit for facilitating movement of a physically impaired person to and from an article of furniture, the unit comprising in combination with the article of furniture:

a base for placement on a horizontal surface;

a horizontal platform large enough for occupancy by and underlying support of a person, the base providing underlying support for the platform;

the platform and the base having association that provides for the platform to have rotational translation about the vertical axis;

and the base including structure that extends horizontally beyond the platform into a physical association with the article of furniture that locates the unit to the article of furniture wherein the platform and the base have association that provides for the platform to also have linear translation along the vertical axis.

17. A unit as set forth in claim 6 in which the article of furniture is a medical examination table having a space between legs of the table and the structure that extends horizontally beyond the platform for association with the article of furniture to locate the unit to the article of furniture is arranged to fit between the legs of the table while the platform remains beyond the table.

18. A unit as set forth in claim 7 including at least one pole extending upwardly from the platform, the at least one pole being located radially of the vertical axis toward an outer perimeter of the platform and an handle that that can be grasped by a person occupying the platform and that is adjustably positionable on the at least one pole.

19. A unit as set forth in claim 6 further comprising wheels underlying the base that provide for the unit to be rolled along a horizontal surface, and two poles extending upwardly from the platform, the poles being located radially of the vertical axis toward an outer perimeter of the platform and being circumferentially spaced apart from each other, and an occupant handle extending horizontally between the poles at a location above the platform for grasping by a person occupying the platform, the occupant handle being associated with the poles by mountings that provide for the occupant handle to be swung downwardly from horizontal position, the occupant handle having a circularly curved shape centered on the vertical axis, and the unit further comprising a strap long enough to extend between the poles behind a person on the platform who is grasping the occupant handle.

* * * * *